US006301743B1

(12) United States Patent
Cloud, III et al.

(10) Patent No.: US 6,301,743 B1
(45) Date of Patent: Oct. 16, 2001

(54) VACUUM CLEANER WITH STATIC DISSIPATION CIRCUIT

(75) Inventors: John A. Cloud, III, Nicholasville, KY (US); Hiroshi Nakao, Yohkaichi (JP)

(73) Assignee: Matsushita Electric Corporation of America, Secaucus, NJ (US)

( * ) Notice: Subject to any disclaimer, the term of this patent is extended or adjusted under 35 U.S.C. 154(b) by 0 days.

(21) Appl. No.: 09/642,678

(22) Filed: Aug. 21, 2000

(51) Int. Cl.[7] ..... A47L 9/28
(52) U.S. Cl. ..... 15/339; 15/412
(58) Field of Search ..... 15/319, 339, 412

(56) References Cited

U.S. PATENT DOCUMENTS 3,711,742 1/1973 Pinkham, Jr. .
4,697,300 10/1987 Warlop .
4,715,085 12/1987 Johanson .
4,715,086 12/1987 Johanson et al. .
4,817,234 * 4/1989 Greulich ..... 15/339
4,866,565 9/1989 Wray, Jr. .
4,958,255 9/1990 Pritchard .
5,040,264 8/1991 Bryant .
5,855,036 1/1999 Krock .

* cited by examiner

*Primary Examiner*—Chris K. Moore
(74) *Attorney, Agent, or Firm*—King & Schickli, PLLC

(57) ABSTRACT

A vacuum cleaner including a suction fan and a suction fan drive motor also includes a power control circuit with a controller, and a reset toggle. First and second capacitors are positioned with one on each side of the reset toggle. A zener diode is also provided. Together, the capacitors and zener diode function to reduce the susceptibility of the power control circuit to undesired reset in response to relatively small and otherwise insignificant power supply and static discharge spikes.

7 Claims, 1 Drawing Sheet

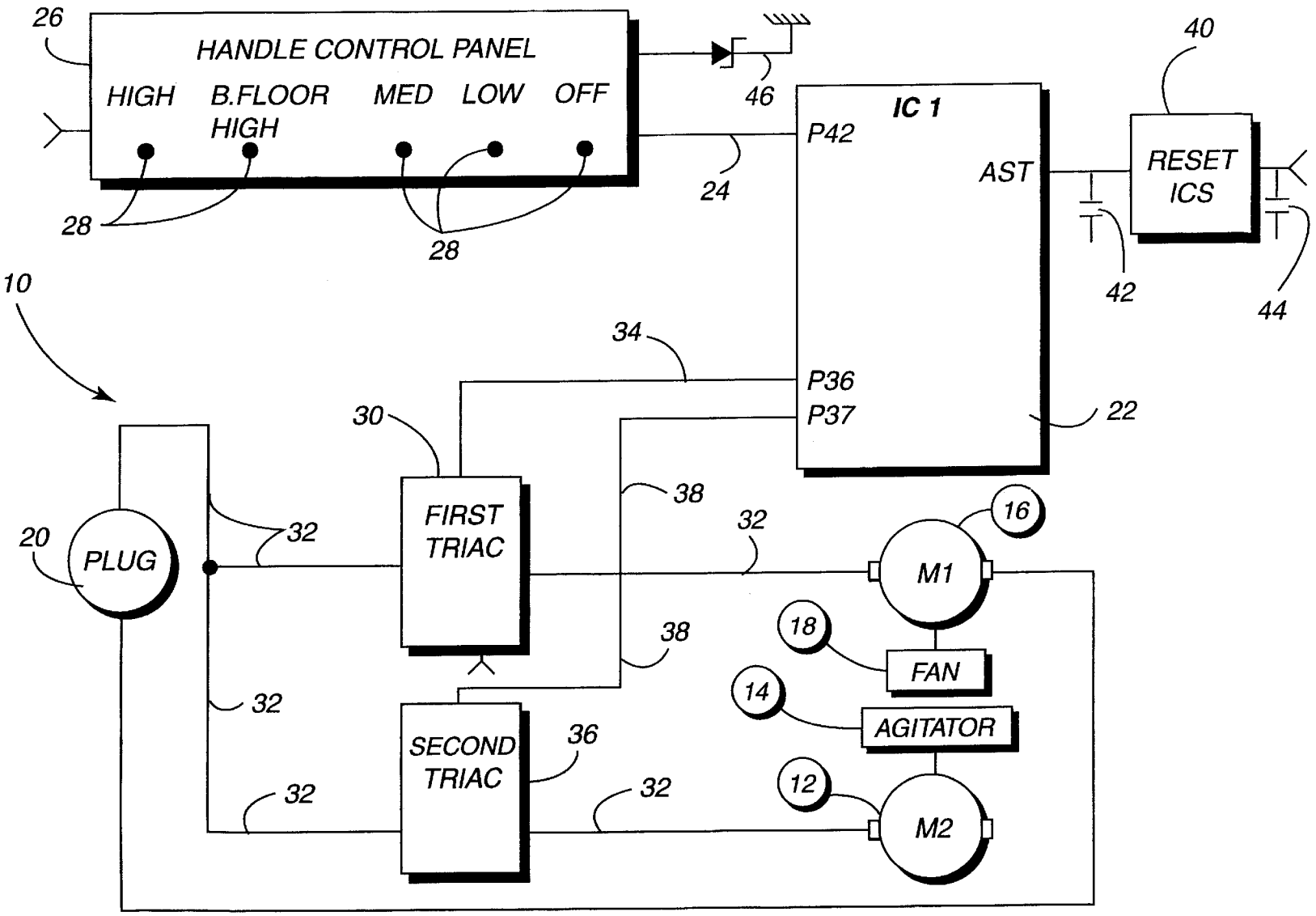
RESET ICS
40
44
42
22
IC 1
AST
P42
P36
P37
46
24
34
38
38
32
16
M1
FAN
AGITATOR
M2
18
14
12
36
FIRST TRIAC
SECOND TRIAC
30
32
32
32
HANDLE CONTROL PANEL
OFF
LOW
MED
B.FLOOR
HIGH
HIGH
28
28
26
10
PLUG
20

VACUUM CLEANER WITH STATIC DISSIPATION CIRCUIT

TECHNICAL FIELD

The present invention relates generally to the field of vacuum cleaners and, more particularly, to a power control circuit for a vacuum cleaner which functions to deliver power from a source of electrical energy to the suction drive motor while dissipating power supply and static discharge spikes which might otherwise cause an undesired reset of the power control circuit and interruption of current to the drive motor.

BACKGROUND OF THE INVENTION

It is well known in the art to provide a vacuum cleaner that comprises a nozzle assembly for picking up dirt and debris from the surface to be cleaned such as a carpeted or hardwood floor and a canister body that has a dust bag for collecting dirt and debris and a suction motor and fan assembly for generating the necessary negative pressure to draw the dirt and debris into the dust bag for collection. The canister body is, of course, supported on wheels so that it may be easily moved from room to room during cleaning. Many vacuum cleaners also include a separate drive motor for driving a rotating agitator brush which includes bristles, beater bars or other structure for beating dirt and debris from the nap of a carpet so that it can be drawn by negative pressure through the nozzle to the dust bag for collection.

As with any electrical appliance, fluctuations in line voltage including line surges such as are caused by lightning strikes, line equipment malfunctions or other reasons affect the electrical supply voltage and, therefore, the current supplied to electrical components including e.g., the switches and the motor or motors of the vacuum cleaner. Additionally, it is well known that air with entrained dirt and debris moving at high speeds through the nozzle and/or wand of the vacuum cleaner and the body of the canister into the dust bag often produce a build-up of electrostatic charge in those components. In extreme situations, the accumulated electrostatic charge may reach an electrical potential sufficiently high to cause an electrostatic discharge which could result in an unpleasant shock to the user of the vacuum cleaner and/or damage to the electrical controls or possibly even one or more of the motors of the vacuum cleaner.

In order to guard against such problems the assignee of the present invention has previously equipped the power control circuit of a vacuum cleaner with a reset toggle which shuts the power control circuit and, more particularly, the microprocessor controller of that circuit off in the event of overwhelming noise in the form of power supply and/or static discharge spikes. In past designs the reset toggle has incorporated a relatively small 0.01 $\mu$F capacitor between the microprocessor controller and the reset toggle and a second 0.01 $\mu$F capacitor between the reset toggle and ground. The capacitors are generally sized so that the reset toggle only operates when noise from power supply and/or static discharge spikes is at least of a certain, predetermined minimum level.

While generally useful for its intended purpose, the prior art design in question is somewhat limited in its ability to limit the operation of the reset toggle: that is, to prevent undesired resets of the power control circuit and interruption of power to the motor or motors of the vacuum cleaner in response to power supply and static discharge spikes that are insufficient to cause true damage or improper operation of the electronic components of the vacuum cleaner.

Accordingly, a need is identified for an improved power control circuit for providing full and complete protection of all the electronic components of the vacuum cleaner from potentially damaging power supply and static discharge spikes while also avoiding undesired interruption to the operation of the vacuum cleaner in response to otherwise insignificant power supply and static discharge spikes.

SUMMARY OF THE INVENTION

In order to achieve the foregoing and other objects, and in accordance with the purposes of the present invention as described herein, a vacuum cleaner is provided including a suction fan and a suction fan drive motor. The vacuum cleaner incorporates an improvement comprising a power control circuit for delivering power from a source of electrical energy to the suction fan drive motor. The power control circuit includes a controller such as a microprocessor controller, a reset toggle, a first capacitor between the controller and the reset toggle and a second capacitor between the reset toggle and ground. Additionally, the power control circuit includes a zener diode between the controller and ground whereby the two capacitors and the zener diode reduce the susceptibility of the power control circuit to undesired reset in response to relatively small and otherwise insignificant power supply and static discharge spikes.

More specifically describing the invention, the first and second capacitors are of a size $\geqq 0.1$ $\mu$F. Additionally, the zener diode has a threshold voltage of between about 25–28 V and more typically about 27.0 V. Together, the larger capacitors and the zener diode are able to absorb more energy due to line surges and sudden electrostatic discharge more quickly than the smaller capacitors utilized in prior art designs thereby making the power control circuit less susceptible to undesired resets in response to relatively small and otherwise insignificant power supply and static discharge spikes. The reset toggle, however, remains fully operative and responsive to reset the power control circuit and protect the electronic components of the vacuum cleaner when significant line surges and static discharge spikes of sufficient strength occur that might otherwise result in damage or improper operation of the vacuum cleaner.

Still other objects of the present invention will become readily apparent to those skilled in this art from the following description wherein there is shown and described a preferred embodiment of this invention simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawing incorporated in and forming a part of the specification, illustrates several aspects of the present invention, and together with the description serves to explain the principles of the invention. In the drawing:

FIG. 1 is a block diagram for a vacuum cleaner incorporating the power control circuit improvement of the present invention.

Reference will now be made in detail to the present preferred embodiment of the invention, an example of which is illustrated in the accompanying drawing.

DETAILED DESCRIPTION OF THE INVENTION

Reference is now made to the drawing FIGURE schematically showing the power control circuit 10 of the present invention. The power control circuit 10 is being illustrated for a vacuum cleaner including a first motor 12 for driving a rotating agitator 14 which beats dirt and debris from the nap of an underlying carpet being cleaned. The power control circuit 10 also includes a second motor 16 for driving a suction fan 18 to produce a vacuum for entraining and drawing dirt and debris lifted by the agitator 14 into the dust bag of the vacuum cleaner.

As should be appreciated as the description hereof proceeds, the power control circuit 10 functions to deliver power from a plug 20 such as a common electrical plug which is connected to a source of electrical energy such as a standard electrical wall outlet to the first and second motors 12, 16 of the vacuum cleaner. More specifically describing the invention, the power control circuit 10 includes a microprocessor controller 22 of a type well known in the art such as an 8 bit/8K controller manufactured by Fujitsu. The controller 22 is connected through a control line 24 to a control panel 26 having various switches 28 allowing the operator of the vacuum cleaner to manually select between various operating conditions. Those conditions illustrated include an off position wherein both the first motor 12 for driving the agitator 14 and the second motor 16 for driving the suction fan 18 are de-energized, a low position wherein the motor 16 is energized at a relatively low power level, a medium position wherein the motor 16 is energized at a relatively intermediate power level, a first high position wherein both the motors 12, 16 are energized at a relatively high power level and a second high position wherein only the suction fan motor 16 is energized at a high level and the agitator drive motor is de-energized. This last position is used for bare floor cleaning. Thus, in the illustrated power control circuit 10, motor power is controlled by manual operation.

A first triac 30 in the power line 32 between the plug 20 and the first motor 16 is connected to the controller 22 through the control line 34. A second triac 36 in the power line 32 between the plug 20 and the second motor 12 is connected to the controller 22 through the control line 38. Thus, as should be appreciated the first triac 30 is wired in series with the first motor 16 for driving the fan 18 whereas the second triac 36 is wired in series with the second motor 16 for driving the agitator 14. The traics 30, 36 regulate AC supply to their respective motors 12, 16 by switching off and on (conducting or not conducting) at varying rates. The rate of triac switching and therefore the power delivered to the motors 12, 16 is determined by the gate signal that is generated and supplied independently by the controller 22 along the control lines 34, 38 to the respective triacs 30, 36. The controller 22 carries an on-board program that generates the gate signals. The signals are chosen by a program based upon operator control through manual selection of the appropriate switch 28.

Specifically, the controller 22 monitors the control line 24 for a DC level. A passive resistor network in the control panel 26 develops this level with the particular button 28 selected having a discrete identifying voltage. When the controller 22 recognizes one of these discrete voltage levels, the controller responds according to its programmed settings to change the triac gate signals. While not shown, the controller 22 also includes other inputs that determine comparison voltages to which the controller responds including, for example, a timing reference that allows the gate pulse to be synchronous with the AC source. As is known in the art, this is necessary as the triacs 30, 36 must be switched on at precise points in the AC cycle in order to work properly.

The electronic components of the vacuum cleaner including but not limited to the motors 12, 16, the controller 22, the control panel 26 and the triacs 30, 36 are protected from potentially damaging supply or line voltage and static discharge spikes by means of a reset toggle 40. In order to prevent undesired resetting of the power control circuit 10 that might otherwise occur in response to relatively small and otherwise insignificant power supply and static discharge spikes insufficiently strong to potentially cause damage to the electronic components of the vacuum cleaner, the power control circuit 10 also includes first and second capacitors 42, 44 on each side of the reset toggle 40 with the first of the capacitors between the controller 22 and the reset toggle. Additionally, the power control circuit includes a zener diode 46 between the control panel 26 and ground. In order to ensure that the reset toggle 40 still provides the desired operation necessary to protect the electronic components of the vacuum cleaner from potentially damaging line voltage and static discharge spikes while at the same time preventing undesired resets to insignificant surges and spikes, the size of the capacitors 42, 44 and the threshold voltage of the zener diode 46 must be carefully selected. It has been found that the first and second capacitors 42, 44 should typically be of a size $\geqq 0.1\ \mu F$. Additionally, the zener diode 46 should have a threshold voltage of between about 25.0 to about 28.0 V and more particularly about 27.0 V. Together, such capacitors 42, 44 and zener diode 46 are able to absorb more energy due to line surges and sudden electrostatic discharge more quickly than was possible in prior art power control circuit designs. This makes the power control circuit 10 of the present invention less susceptible to undesired resets in response to relatively small and otherwise insignificant power supply and static discharge spikes. As noted above, however, the reset toggle 40 remains fully operative and responsive to reset the power control circuit 10 and protect the electronic components of the vacuum cleaner when significant line surges and/or static discharge spikes of sufficient strength occur that might otherwise result in damage or improper operation of the vacuum cleaner.

The foregoing description of a preferred embodiment of this invention has been presented for purposes of illustration and description. It is not intended to be exhaustive or to limit the invention to the precise form disclosed. Obvious modifications or variations are possible in light of the above teachings.

For example, while the power control circuit 10 of the present invention is described and illustrated with respect to a vacuum cleaner incorporating only manual motor power control through operation of the switches 28 on the control panel 26, the circuit is equally applicable to vacuum cleaners incorporating automatic operation control responsive to changes in operating conditions. For example, the vacuum cleaner may respond to fluctuations in source voltage and/or fluctuations in the current provided to one or both of the motors due to a full dust bag. Additionally, while the power control circuit 10 of the present invention has been described and illustrated with respect to a vacuum cleaner including separate motors 12, 16 for driving the agitator and suction fan respectively, it should be appreciated that the circuit may be utilized on a vacuum cleaner incorporating a single motor for driving only the suction fan and/or the suction fan and the agitator.

The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

What is claimed is:

1. In a vacuum cleaner including a suction fan and a suction fan drive motor, an improvement, comprising: a power control circuit for delivering power from a source of electrical energy to said suction fan drive motor; said power control circuit including a controller, a reset toggle, a first capacitor on one side of said reset toggle between said controller and said reset toggle, a second capacitor on an opposite side of said reset toggle; and a zener diode, whereby said first and second capacitors and said zener diode reduce susceptibility of said power control circuit to undesired reset in response to relatively small and otherwise insignificant power supply and static discharge spikes.

2. The vacuum cleaner of claim 1, wherein said first and second capacitors are of a size $\geqq 0.1\ \mu F$.

3. The vacuum cleaner of claim 2, wherein said zener diode has a threshold voltage of between 25.0–28.0 V.

4. The vacuum cleaner of claim 2, wherein said zener diode has a threshold voltage of about 27.0 V.

5. The vacuum cleaner of claim 1, wherein said zener diode has a threshold voltage of between 25.0–28.0 V.

6. The vacuum cleaner of claim 1, wherein said zener diode has a threshold voltage of about 27.0 V.

7. The vacuum cleaner of claim 1 including a control panel connected to said controller, said zener diode being positioned between said control panel and ground.

* * * * *